US005978490A

United States Patent [19]

Choi et al.

[11] Patent Number: 5,978,490

[45] Date of Patent: Nov. 2, 1999

[54] DIRECTIVITY CONTROLLING APPARATUS

[75] Inventors: Hyun-Woo Choi; Jin-Sung Lee, both of Kyungki-do, Rep. of Korea

[73] Assignee: LG Electronics Inc., Seoul, Rep. of Korea

[21] Appl. No.: 08/997,885

[22] Filed: Dec. 24, 1997

[30] Foreign Application Priority Data

Dec. 27, 1996 [KR] Rep. of Korea ..... 96-73862

[51] Int. Cl.[6] ..... H04R 3/00

[52] U.S. Cl. ..... 381/92; 381/107; 381/120

[58] Field of Search ..... 381/92, 94.7, 94.1, 381/119, 120, 110, 104, 107

[56] References Cited

U.S. PATENT DOCUMENTS 5,208,864 5/1993 Kaneda ..... 381/92
5,414,776 5/1995 Sims, Jr. ..... 381/97.4
5,602,962 2/1997 Kellermann ..... 381/94.7
5,673,327 9/1997 Julstrom ..... 381/94.5

*Primary Examiner*—Ping Lee
*Attorney, Agent, or Firm*—Finnegan, Henderson, Farabow, Garrett & Dunner, L.L.P.

[57] ABSTRACT

A directivity controlling apparatus and method of a microphone system for collecting audio signals in an audio recording/reproducing system. A certain microphone in the system is selected to have directivity according to a result of comparing levels of input signals supplied into plural partial microphones in a supervisory mode by categorizing directional microphones into a directional mode and the supervisory mode. An automatic shift operation is performed during the supervisory mode, in which audio signal levels received via the plural partial microphones are compared to select a certain microphone to have the specific directivity and, then, the input level of the particular microphone having the directivity is monitored to repeat the supervisory mode according to the monitored input level.

4 Claims, 11 Drawing Sheets

NON-DIRECTIVITY

SINGLE DIRECTIVITY

SUPER DIRECTIVITY

PERIPHERY DIRECTIVITY

DIRECTIVITY CONTROLLING APPARATUS

BACKGROUND OF THE INVENTION

A. Field of the Invention

The present invention relates to a microphone system for collecting audio signals in an apparatus such as an audio recording/reproducing system, and more particularly to a directivity controlling apparatus of a microphone system and a method for controlling the same.

B. Description of the Prior Art

A microphone system for collecting to record audio signals has been suggested by systems of, as shown in FIGS. 1A to 1D, non-directivity having the same sensitivity with respect to the omni-direction of the microphone, single directivity having sensitivity concentrated in the slightly wide direction with respect to the front area of the microphone, super directivity having sensitivity concentrated in the extremely narrow front area of the microphone and periphery directivity having sensitivity concentrated in the right and left sides of the microphone.

FIG. 2 is a view showing a conventionally general mono audio processing system, which utilizes the non-directional, single directional, super directional or periphery directional microphone.

Audio signals respectively collected via a plurality of microphones 21*a*, 21*b* and 21*c* are mixed in an adder 23 via respective amplifiers 22*a*, 22*b* and 22*c*. A single monophonic audio signal provided from adder 23 is gain-controlled in an AGC circuit 24*a* and modulated by a predetermined frequency in a modulating circuit 24*b* of an audio signal processing part 24 to be provided to a recording system at the succeeding stage.

FIG. 3 is a view showing a conventionally general stereo audio processing system, in which an audio signal of a left channel L and an audio signal of a right channel R are received into respective microphones 31*a* and 31*b* to be amplified in respective amplifiers 32*a* and 32*b*. Then, the amplified signals are supplied into an audio signal processing part 33. At this time, audio signal processing part 33 has a first AGC circuit 34*a* and a first modulating circuit 34*b* for processing the audio signal of left channel L, and a second AGC circuit 34*c* and a second modulating circuit 34*d* for processing the audio signal of right channel R, thereby executing the audio signal processing upon respective channels. Thereafter, the signal from first modulating circuit 34*b* and signal from second modulating circuit 34*d* are provided to an adder 35*e*. Thus, adder 35*e* provides a L/R mixed stereo audio signal.

Referring to FIG. 4, audio signals depending on respective directivities of a middle microphone 41*a* and a side microphone 41*b* respectively having the single directivity and periphery directivity are collected. The collected audio signals are then amplified in respective amplifiers 42*a* and 42*b*, and added in an adder 42*c* to be supplied into an audio signal processing part 43.

Audio signal processing part 43 performs the automatic gain controlling and modulating processing upon a middle/side audio signal supplied from adder 42*c* both in an AGC circuit 43*a* and a modulating circuit 43*b* with respect to the first channel and in an AGC circuit 43*c* and a modulating circuit 43*d* with respect to the second channel, thereby providing a middle/side stereo signal obtained by being added in an adder 43*e*.

The conventional directional microphone system is categorized into the non-directivity, single directivity, super directivity and periphery directivity. A desired directivity effect can be obtained only by using a microphone(s) having a specific directivity.

Also, in case of using the directional microphone, the directivity is shifted according to the user's selection, and this is a cumbersome process. Moreover, this process induces the problems of impairing the collected audio signals resulting from unsuitable timing of the shift and impeding the recording of desired audio signals when recording the collected audio signals.

In particular, although the stereo microphone has the directivity shaped like a letter "V," the directivity with respect to the direction can be secured by the amplification level of the same magnitude based on a typical, preset gain value, i.e., just by the simple amplification of the received signals solely depending on the microphone directivity regardless of the magnitude of the input signal (input sound).

SUMMARY OF THE INVENTION

Therefore, it is an object of the present invention to provide a flexible directivity controlling apparatus and method of a microphone system that change the directivities of two or more microphones based on the magnitudes of the respective input signals.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

To achieve the objects and in accordance with the purpose of the invention, as embodied and broadly described herein, the invention comprises a directivity controlling apparatus of a microphone system including a first microphone for collecting a first audio signal; a second microphone for collecting a second audio signal; a first amplifier for receiving and amplifying said first audio signal by a first amplification factor; a second amplifier for receiving and amplifying said second audio signal by a second amplification factor; a comparator for comparing values of said first and second audio signals; and a controller for varying said first and second amplification factors based on a result of the comparison of said comparator.

In a further aspect, the invention comprises a directivity controlling method of a microphone system comprising generating a first audio signal from a first microphone; generating a second audio signal from a second microphone; comparing magnitudes of the first and second audio signals; and variably controlling a first amplification factor and a second amplification factor in accordance with a result of the comparison so as to variably amplify the first and second audio signals.

It is to be understood that both the foregoing general description and the following detailed description are exemplary and explanatory only and are not restrictive of the invention, as claimed.

The accompanying drawings, which are incorporated in and constitute a part of this specification, illustrate embodiments of the invention and together with the description, serve to explain the principles of the invention.

DETAILED DESCRIPTION OF THE PREFERRED EMBODIMENTS

Figure 1A:
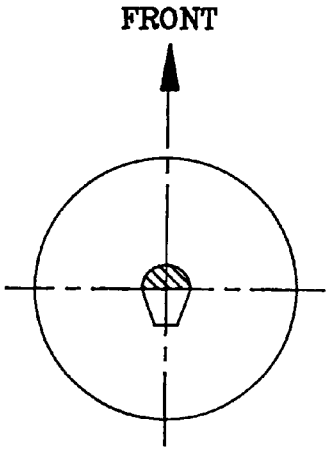
FIGS. 1A to 1D are views showing several directivities of a microphone.
Figure 1B:
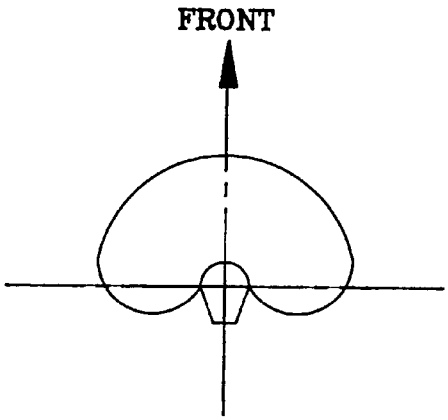
Figure 1C:
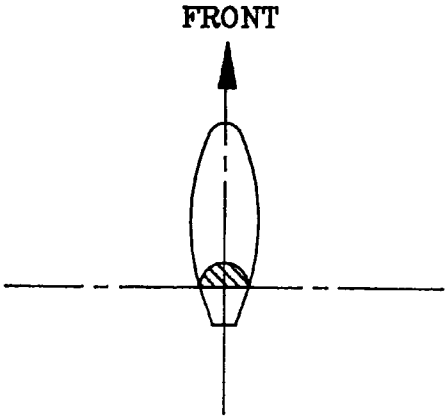
Figure 1D:
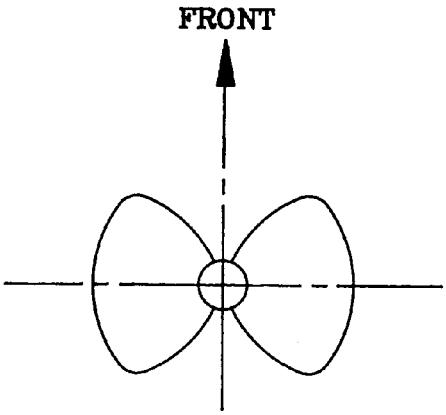
Figure 2:
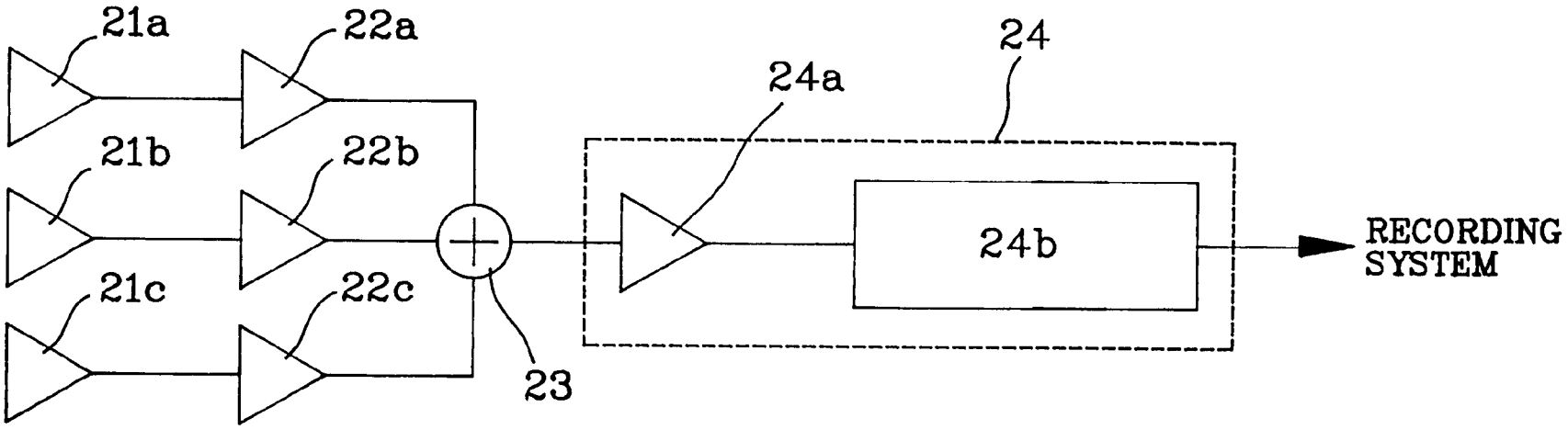
FIG. 2 PRIOR ART
FIG. 2 is a block diagram showing a construction of a conventional mono microphone system.
Figure 3:
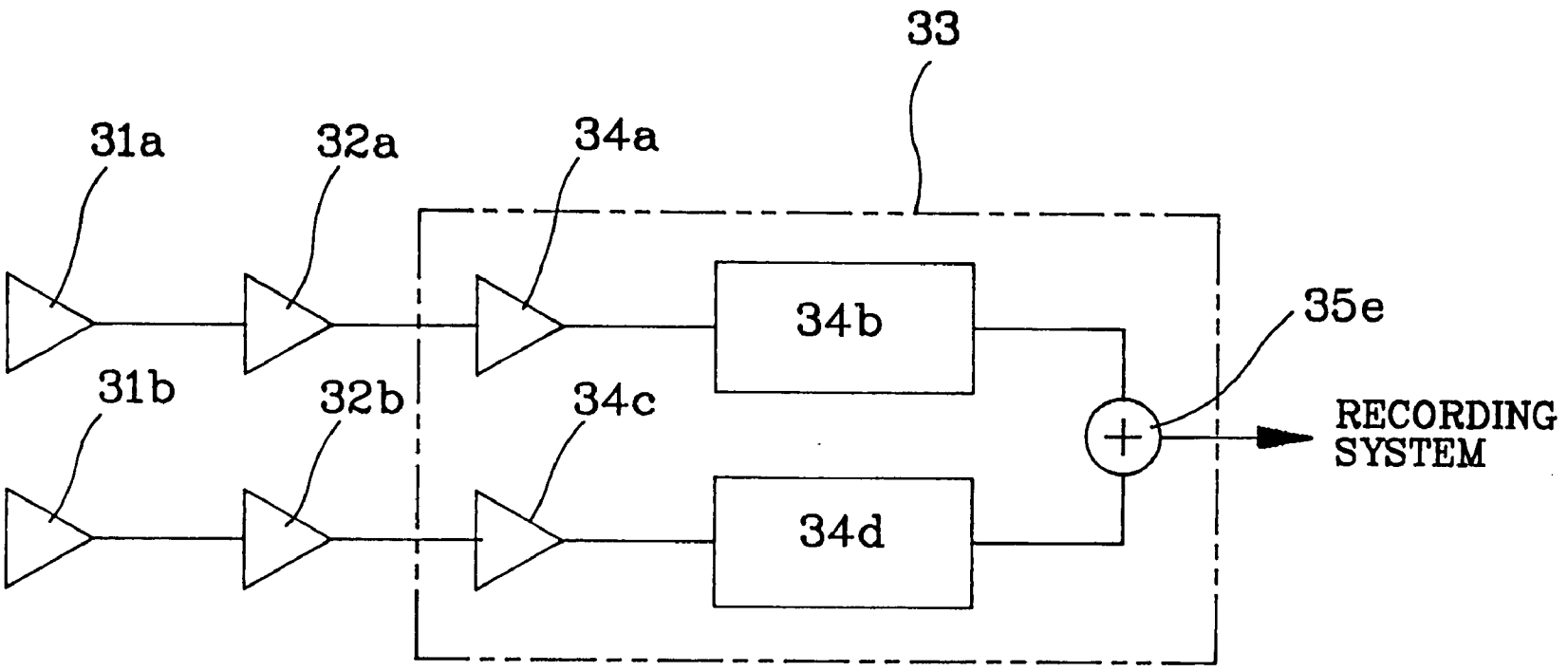
FIG. 3 PRIOR ART
FIG. 3 is a block diagram showing a construction of a conventional stereo microphone system.
Figure 4:
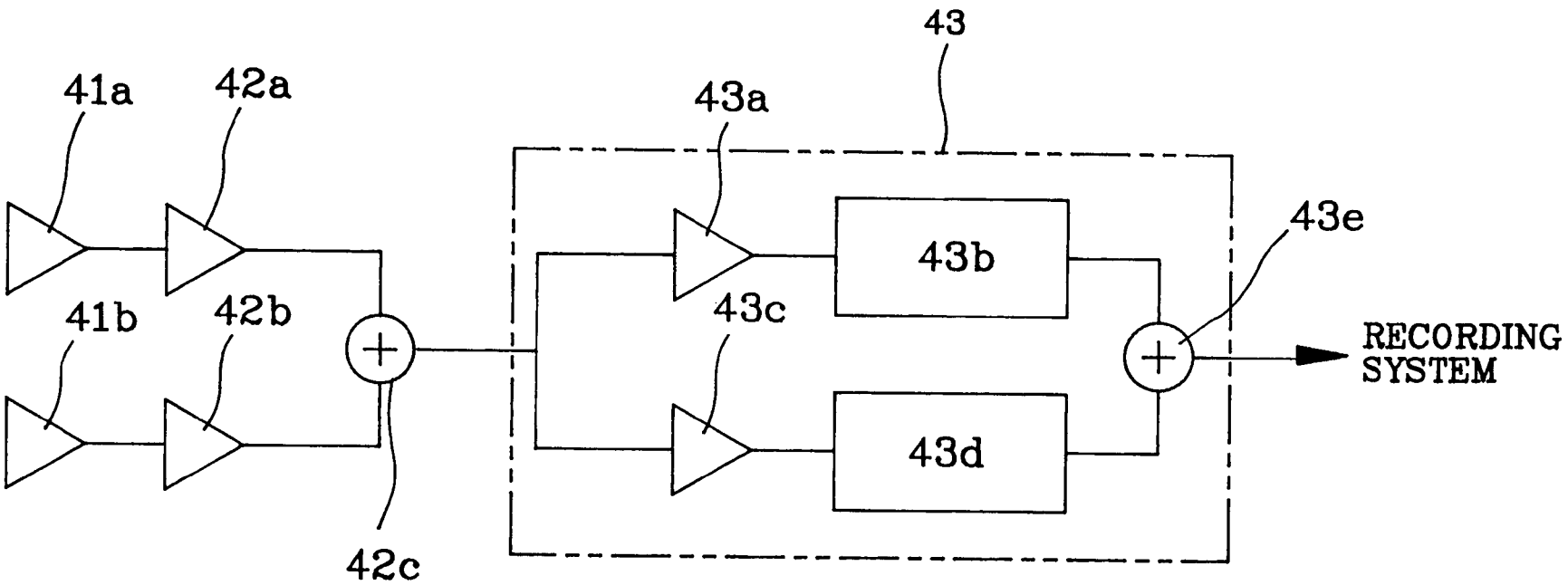
FIG. 4 PRIOR ART
FIG. 4 is a block diagram showing a construction of a conventional middle/side stereo microphone system.
Figure 5:
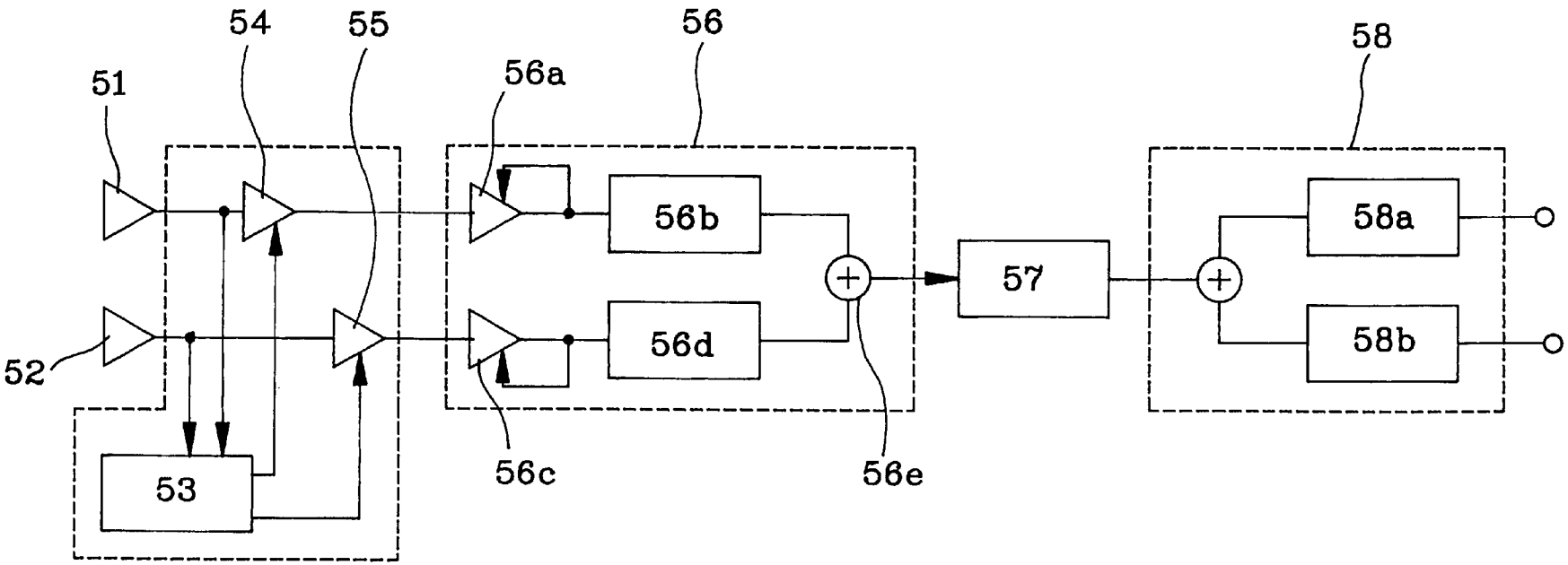
FIG. 5 is a block diagram showing a construction of a first embodiment of a microphone directivity controlling apparatus according to the present invention.

FIG. 5 is a block construction view showing a first embodiment of a directivity controlling apparatus of a microphone system according to the present invention, which illustrates an example of a stereo or middle/side stereo system.

As shown in FIG. 5, the first embodiment of the present invention is formed by a first microphone 51 and a second microphone 52 for collecting audio signals, and a comparative controlling part 53 for comparing the audio signals respectively supplied from first and second microphones 51 and 52 in a supervisory mode to provide a directivity controlling signal. Also, a first amplifier 54 has a gain varied under the control of comparative controlling part 53 to provide the directivity with respect to the input signal of first microphone 51, and a second amplifier 55 has a gain varied under the control of comparative controlling part 53 to provide the directivity with respect to the input signal of second microphone 52. Also included as parts of the directivity controlling apparatus are an audio signal processing part 56 for performing the signal processing operation to record the audio signals from respective amplifiers 54 and 55, and a recording/reproducing part 57 for recording the audio signals processed in audio signal processing part 56 and reproducing the recorded signals. Additionally, an output part 58 demodulates to provide the audio signal reproduced from recording/reproducing part 57.

Audio signal processing part 56 includes a first AGC circuit 56*a* for automatically gain-controlling the output of first amplifier 54 and a first modulating circuit 56*b* for performing the frequency modulation upon the signal from first AGC circuit 56*a* with a first modulating frequency. Also, a second AGC circuit 56*c* automatically gain-controls the output of second amplifier 55, and a second modulating circuit 56*d* frequency-modulates the signal from second AGC circuit 56*c* with a second modulating frequency. Additionally, audio signal processing part 56 has an adder 56*e* which sums up to provide the audio signals modulated in respective modulating circuits 56*b* and 56*d*.

The foregoing construction is of the circuit for processing the stereo audio signal. As for the construction for the middle/side stereo processing, an adder for summing up the outputs of first and second amplifiers 54 and 55 is further connected to the input stage of AGC circuits 56*a* and 56*b*.

Meantime, output part 58 is formed by a first demodulating circuit 58*a* and second demodulating circuit 58*b* for respectively performing the signal demodulating operation by means of frequencies corresponding to modulating circuits 56*b* and 56*d*.

A general operation (directional mode) of the present invention constructed as above will be described hereinbelow.

The audio signal collected via first microphone 51 is supplied into first amplifier 54 to be amplified by a predetermined amplification factor G1, and the amplified signal is recorded on recording/reproducing part 57 via audio signal processing part 56. Also, the audio signal collected via second microphone 52 is supplied into second amplifier 55 to be amplified by a predetermined amplification factor G2, and the amplified signal is recorded on recording/reproducing part 57 via audio signal processing part 56.

At this time, amplification factors G1 and G2 of first amplifier 54 and second amplifier 55 are controlled by comparative controlling part 53.

First AGC circuit 56*a* of audio signal processing part 56 automatically controls the gain of the signal amplified in first amplifier 54, and the automatically gain-controlled signal is frequency modulated by first modulating circuit 56*b* with the first frequency to be supplied into adder 56*e*. Second AGC circuit 56*c* automatically controls the gain of the signal amplified in second amplifier 55, and the automatically gain-controlled signal is frequency modulated by second modulating circuit 56*d* with the second frequency to be supplied into adder 56*e*. In turn, adder 56*e* adds the signal from first modulating circuit 56*b* to the signal from second modulating circuit 56*d*, thereby providing the resultant signal to recording/reproducing part 57. By this operation, the audio signal of the L/R channel is recorded in the form of being frequency modulated.

When reproducing the signal recorded in this manner, a playback output signal of recording/reproducing part 57 is separately demodulated by first and second demodulating circuits 58*a* and 58*b* of output part 58, thereby being externally provided as the stereo.

On the other hand, in case of the supervisory mode, comparative controlling part 53 controls the increase and decrease of amplification factors G1 and G2 of first amplifier 54 and second amplifier 55 in accordance with the result of comparing the collected plurality of audio signals to make microphones 51 and 52 have directional sensitivities different from each other.

In other words, audio signal input values A1 and A2 received via microphones 51 and 52 are compared with each other in the supervisory mode to control amplification factor G1 of first amplifier 54 to be greater than amplification factor G2 of second amplifier 55 in case that A1>A2. By controlling in this manner, first microphone 51 has the directional sensitivity greater than that of second microphone 52.

Then, audio input value A1 is compared with a predetermined reference value Ref to maintain the relation that G1>G2 when A1≦Ref. Whereas, if A1>Ref the above-described steps in connection with the supervisory mode are repeated.

When A1<A2 in the supervisory mode, amplification factor G2 of second amplifier 55 is controlled to be greater than amplification factor G1 of first amplifier 54. By doing so, second microphone 52 has the greater directional sensitivity than the first microphone 51.

After this, audio input value A2 is compared with predetermined reference value Ref to maintain the relation that G1<G2 when A2≦Ref. Whereas, if A2>Ref, the aforementioned steps in accordance with the supervisory mode are repeated.

Figure 6:
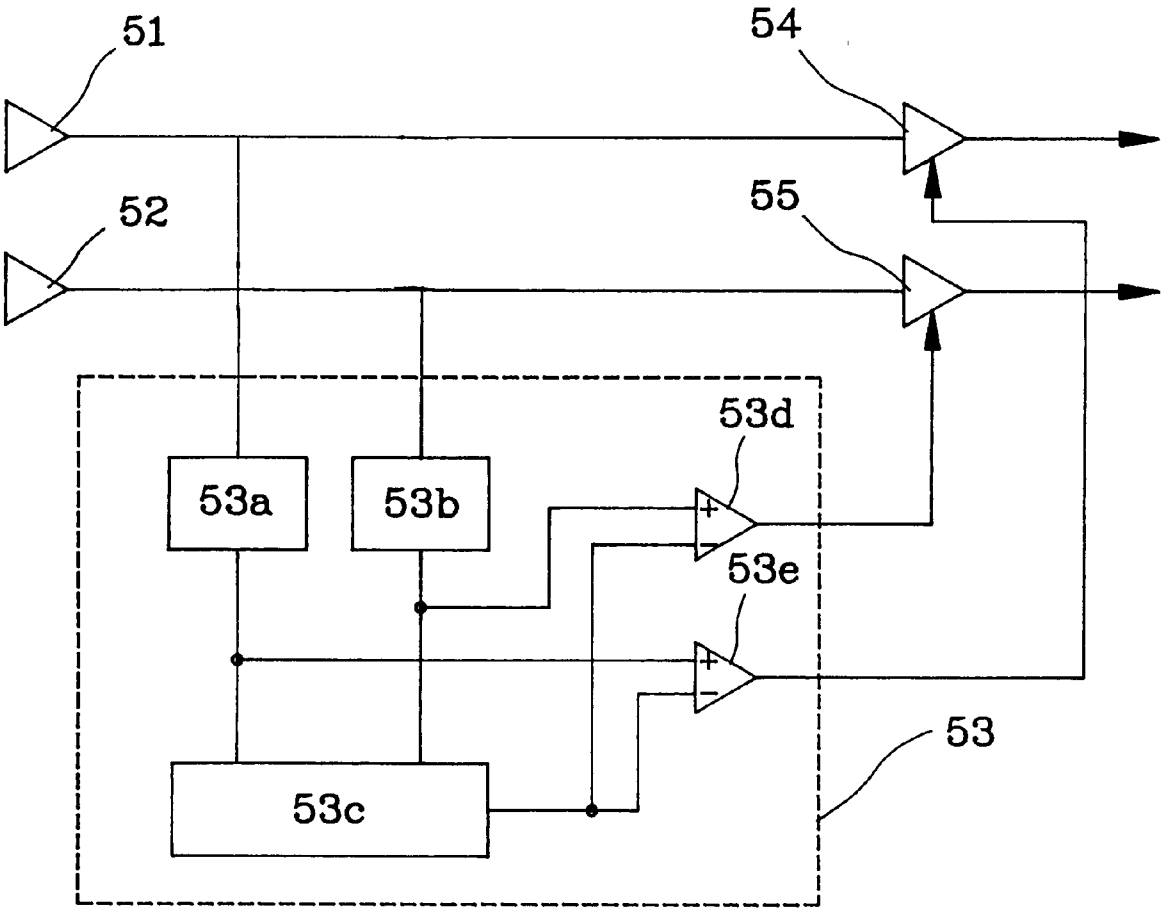
FIG. 6 is a detailed view showing one embodiment of the comparative controlling part of FIG. 5.

FIG. 6 illustrates one embodiment of comparative controlling part 53 of FIG. 5.

In comparative controlling part 53, a first quantizer 53*a* and a second quantizer 53*b* respectively quantize the audio signals collected through microphones 51 and 52, and an operator 53*c* averages respective audio signal values Q1 and Q2 quantized in first and second quantizers 53*a* and 53*b* to provide a comparative reference value. Additionally, comparators 53*d* and 53*e* control amplification factors G1 and G2 of amplifiers 54 and 55 by comparing output values of quantizers 53*a* and 53*b*, using an output of operator 53*c* as a reference value of the comparison.

First quantizer 53*a* quantizes the audio signal collected via first microphone 51, and second quantizer 53*b* quantizes the audio signal collected via second microphone 52. Operator 53*c* averages output values Q1 and Q2 of first and second quantizers 53*a* and 53*b* to supply the mean value to comparators 53*d* and 53*e* as the reference value.

Comparator 53*d* compares the reference value with input value A2 of second microphone 52 quantized in second quantizer 53*b*, and comparator 53*e* compares the reference value with input value A1 of first microphone 51 quantized in first quantizer 53*a*. In accordance with the result of the comparison, gain G1 of first amplifier 54 and gain G2 of second amplifier 55 are controlled to allow for having the directional sensitivities different from each other.

Figure 7:
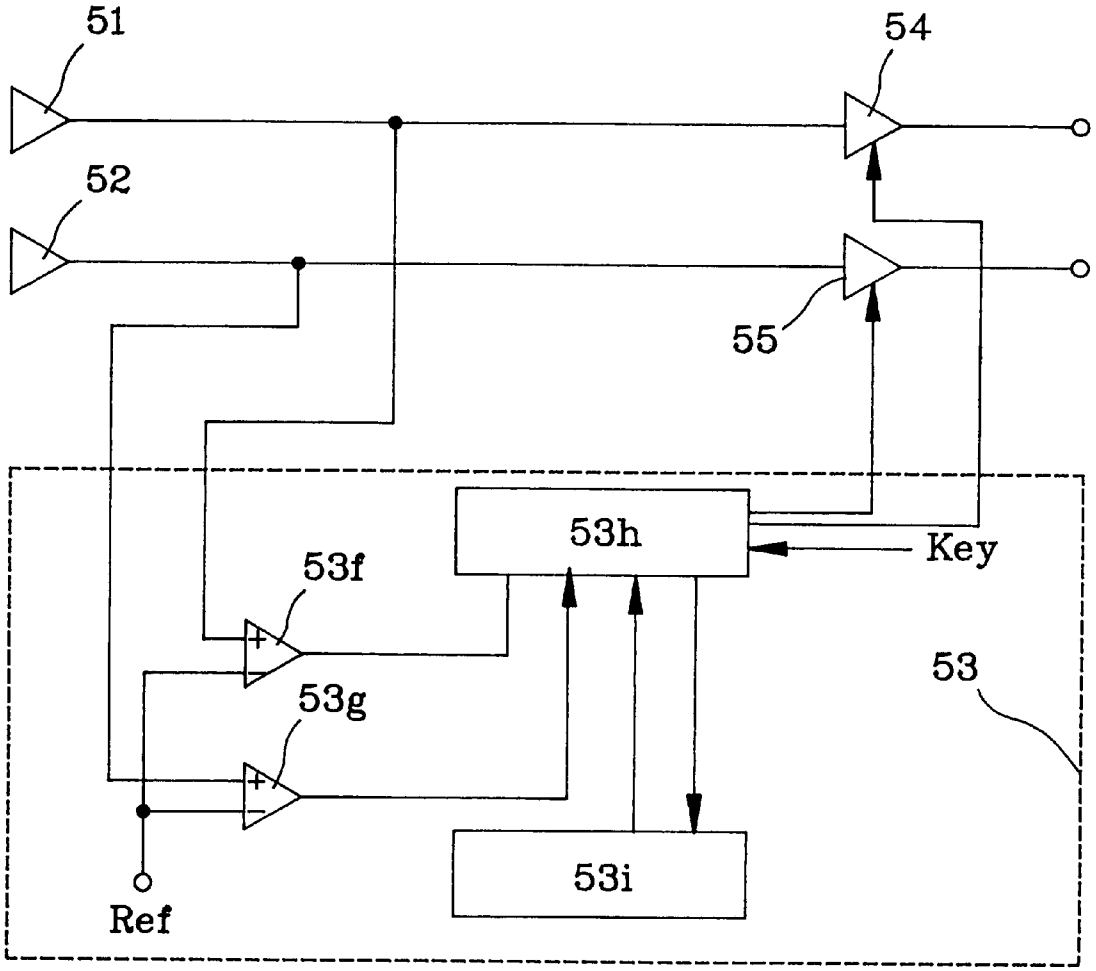
FIG. 7 is a detailed view showing another embodiment of the comparative controlling part of FIG. 5.

FIG. 7 shows another embodiment of comparative controlling part 53 of FIG. 5, in which the presence and absence of an input sound is monitored for a predetermined time in the directional mode, and the directivity controlling operation in accordance with the supervisory mode is executed in view of the result of the monitoring.

Comparative controlling part 53 according to this embodiment is formed by a first comparator 53*f* for comparing audio signal A1 collected via first microphone 51 with a reference value Ref for determining the presence and absence of the input sound, and a comparator 53*g* for comparing audio signal A2 collected via second microphone 52 with reference value Ref for determining the presence and absence of the input sound. Also included as a part thereof is a controlling part 53*h* for receiving the result of the comparison of comparators 53*f* and 53*g* and performing the directivity controlling operation in accordance with the presence and absence of the input sound by controlling amplification factors G1 and G2, using time information of a timer 53*i*. Here, timer 53*i* provides the time information to controlling part 53*h*.

Controlling part 53*h* temporarily controls the gains of amplifiers 54 and 55 to have predetermined amplification factors (initial values) via a key input, and, upon the conversion to the supervisory mode, controls to allow either one of them to have the selectively higher directional sensitivity by variably controlling amplification factors G1 and G2 obtained by comparing the magnitudes of audio signals A1 and A2.

Thereafter, the presence and absence of the input sound is determined by using the time information of timer 53*i*. For example, the fact that the output of first comparator 53*f* maintains the low state for a preset predetermined time denotes no input sound into first microphone 51. Consequently, amplification factors G1 and G2 of amplifiers 54 and 55 are controlled to have the initial values, and the above-described steps in association with the decision whether it is of the supervisory mode or not are carried out.

The operation with respect to second comparator 53*g* for detecting the presence and absence of the input sound of second microphone 52 is the same as that described with reference to first comparator 53*f*.

Figure 8:
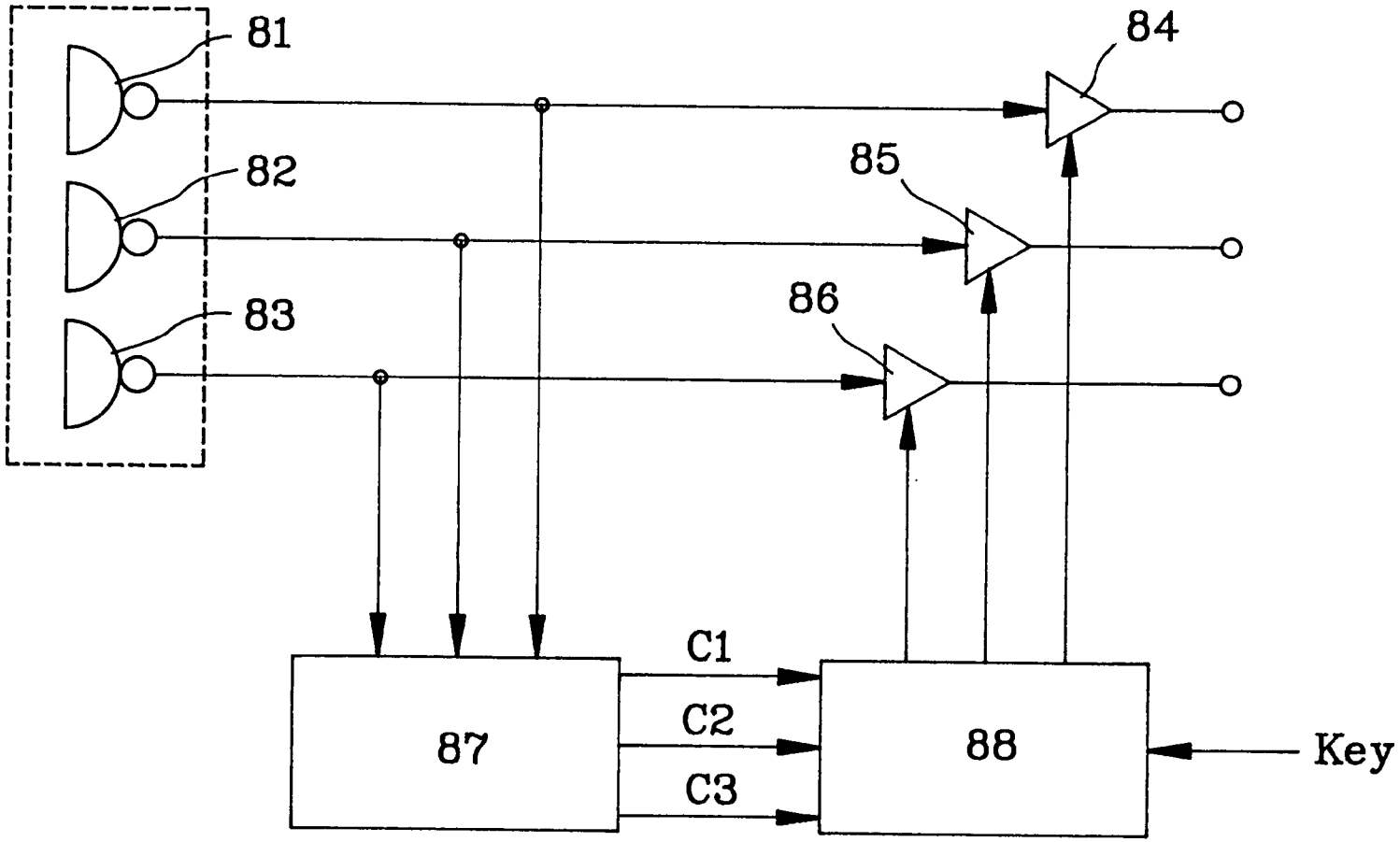
FIG. 8 is a block diagram showing a construction of a second embodiment of the directivity controlling apparatus of the microphone system according to the present invention.

FIG. 8 is a block diagram showing a construction of a second embodiment of the directivity controlling apparatus of the microphone system according to the present invention, in which audio signals received via respective microphones 81, 82 and 83 are amplified by respectively different amplifiers 84, 85 and 86 to lead three microphones 81, 82 and 83 to have the directional sensitivities which are selectively different from one another.

For controlling such an operation, there is provided a comparator 87 for comparing the inputs of three microphones 81, 82 and 83, and a controlling part 88 for receiving the result of the comparison and variably-controlling gains G1, G2 and G3 of amplifiers 84, 85 and 86 in response to the key input.

Although the embodiment shown in FIG. 8 is the directivity controlling system with respect to three microphone inputs, it is operated and effected to be substantially identical to that shown in FIG. 5 or 7.

Figure 9:
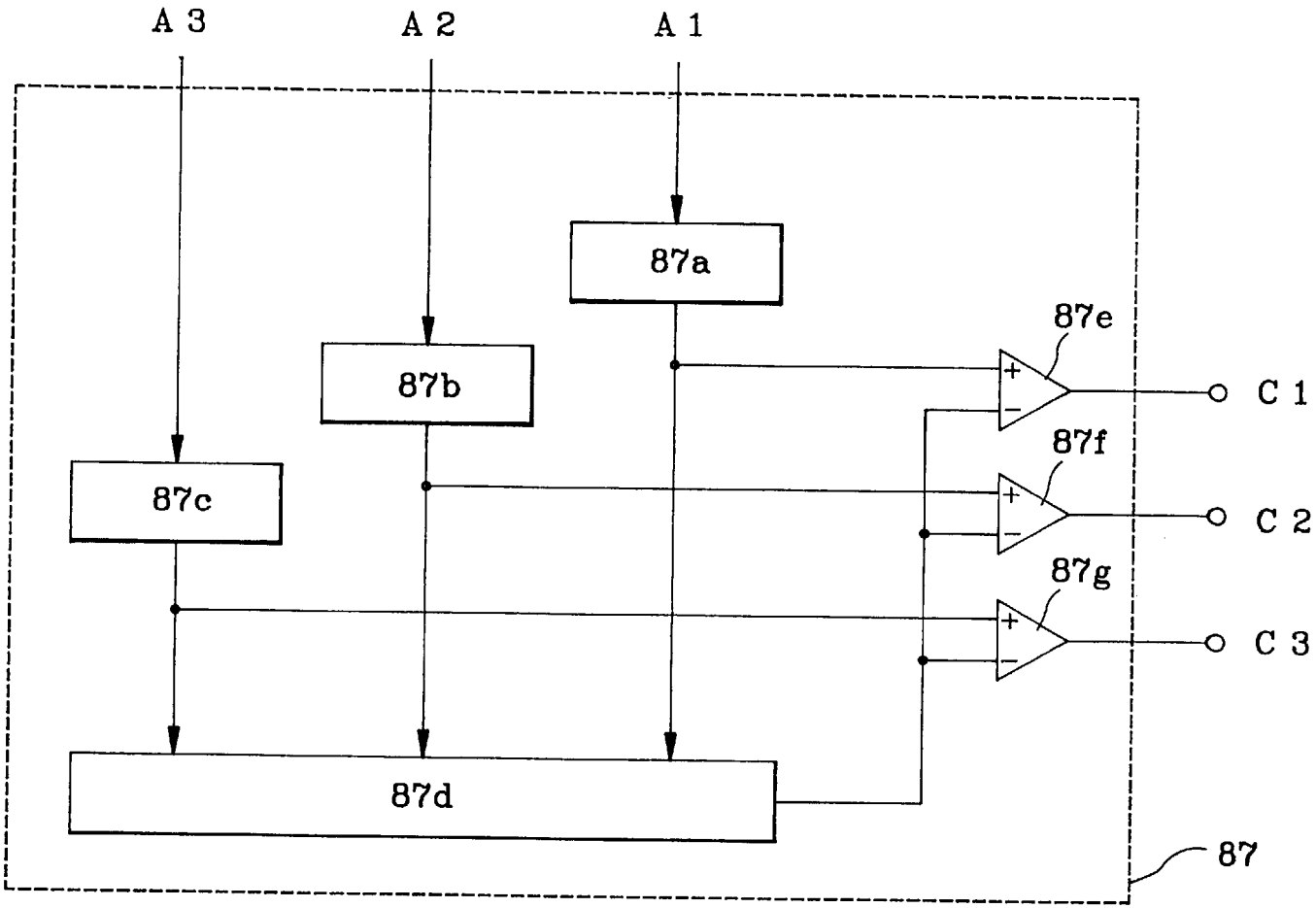
FIG. 9 is a detailed view showing the comparing part of FIG. 8.

FIG. 9 illustrates one embodiment of comparator 87 shown in FIG. 8, which is almost the same as shown in FIG. 6 that employs the quantizers.

Here, since it is of the directivity controlling system with respect to three microphones, comparative part 87 includes quantizers 87*a*, 87*b* and 87*c* for respectively quantizing the signals collected via three microphones 81, 82 and 83, and an operator 87*d* for performing the averaging operation upon output values Q1, Q2 and Q3 of quantizers 87*a*, 87*b* and 87*c* to provide a reference value Ref. Additionally, comparators 87*e*, 87*f* and 87*g* compare respectively quantized microphone output values Q1, Q2 and Q3 by using an output of operator 87*d* as a reference value to supply and provide the result of comparison into controlling part 88.

In this embodiment, quantizers 87*a*, 87*b* and 87*c* quantize three microphone input signals A1, A2 and A3. Operator 87*d* receives to average quantized values Q1, Q2 and Q3 to provide the mean value as reference value Ref. Also, comparators 87*e*, 87*f* and 87*g* respectively compare quantized values with the reference value to provide results C1, C2 and C3 of the comparison to controlling part 88 as signals of high level or low level.

Therefore, controlling part 88 performs the comparative determination of the input sound levels of microphones 81, 82 and 83, and variably controls the amplification factors of amplifiers 84, 85 and 86 in response to the result of the comparison to lead three microphones 81, 82 and 83 to have the directional sensitivities at least different from one another.

Figure 10:
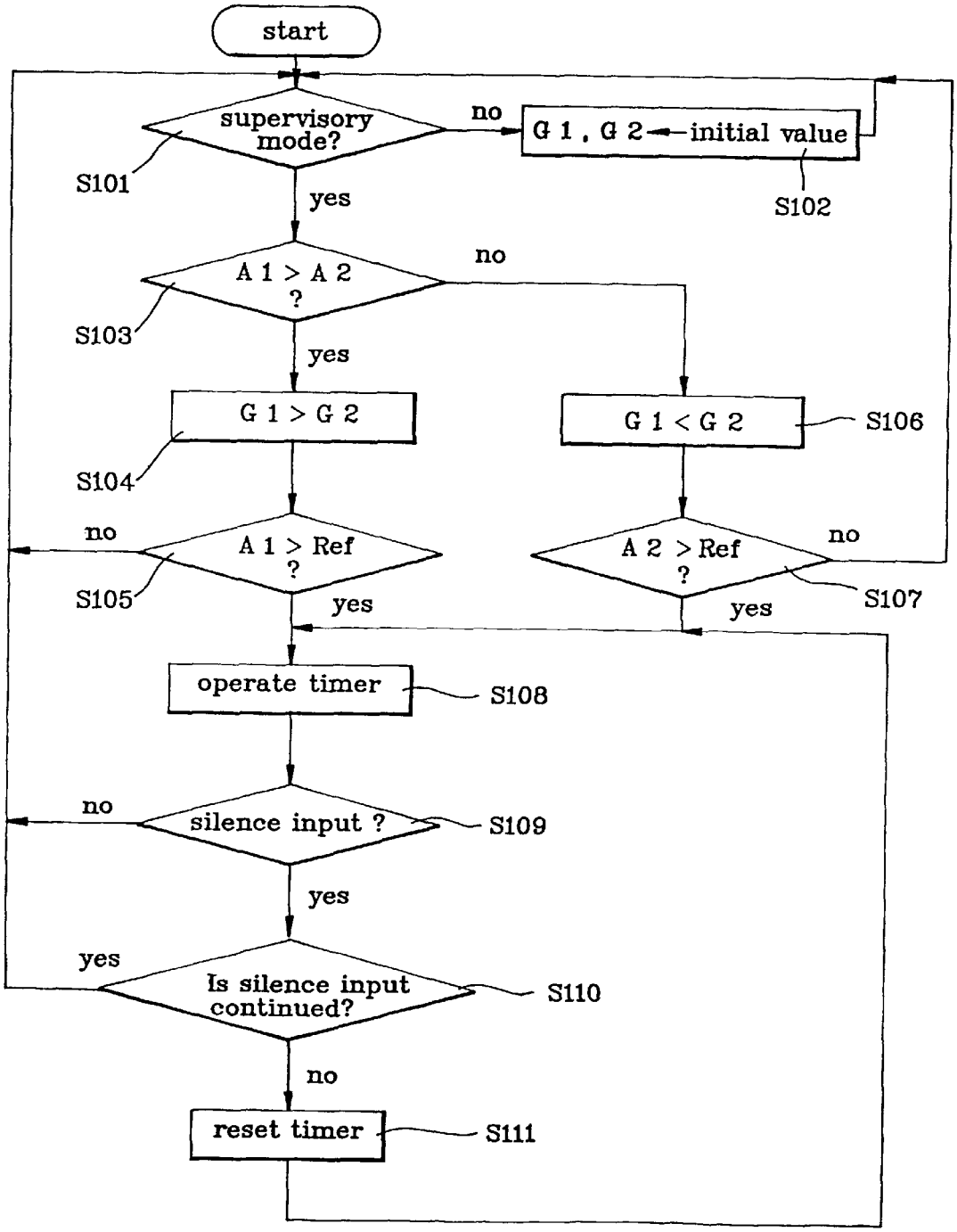
FIG. 10 is a flowchart for explaining a directivity controlling method of the microphone system according to the present invention.

FIG. 10 is a flowchart for explaining a directivity controlling method of the microphone system according to the present invention.

This embodiment shows a case that the directivity controlling operation is performed with respect to two input audio signals A1 and A2 when converted to the supervisory mode by the external key input or automatic conversion.

The controlling method according to this embodiment may be applied to all directivity controlling apparatuses of the aforementioned microphone system (for example, the controlling method also applies to the case of having three microphone inputs).

To begin with, in step S101, it is determined whether the microphone is in the supervisory mode or not. If it is decided that the microphone is in the supervisory mode, the program proceeds to step S103. Otherwise, it proceeds to step S102. Unless the microphone is in the supervisory mode, amplification factors G1 and G2 of the amplifiers are designated by the previously-set predetermined initial values in step S102 to return to step S101.

When the microphone is in the supervisory mode, in step S103, first audio input A1 and second audio input A2 are compared with each other. The result of the comparison presents that A1>A2, it proceeds to step S104. In case that A1≦A2, it proceeds to step S106. In step S104, the amplification factors G1 and G2 are adjusted to have the relation that G1>G2. That is, the directivity is afforded toward the first audio input channel.

In step S105, first audio input A1 is compared with predetermined reference value Ref to proceed to step S108 when the comparison results in the relation that A1>Ref. If the comparison A1≦Ref, the program returns to step S101, thereby repeating the foregoing steps.

On the other hand, when A1≦A2 in step S103, it proceeds to step S106 to control the amplification factors G1 and G2 to have the relation that G1<G2. That is, the directivity is afforded toward the second audio input channel.

In step S107, first audio input A2 is compared with predetermined reference value Ref to proceed to step S108 when the result of the comparison presents that A2>Ref. If the comparison results in the relation that A2≦Ref, the program returns to step S101 to repeat the above-described steps.

In step S108, the timer is operated. Thereafter, in step S109, the reference value of silence input is compared with audio input A1 or A2 to judge whether the silence input exists or not. When it is decided that there is the silence input, it proceeds to step S110. Otherwise, the foregoing steps are repeated by returning to step S101 unless the silence input exists.

In step S110, it is determined whether the silence input is continued during a preset time period. If audio input A1 or A2 exists within the preset time, it proceeds to step S111. Otherwise, it returns to step S101, thereby executing a new directional sensitivity control.

In step S111, the timer is reset prior to returning to step S108, thereby repeating steps S108 to S111.

Figure 11:
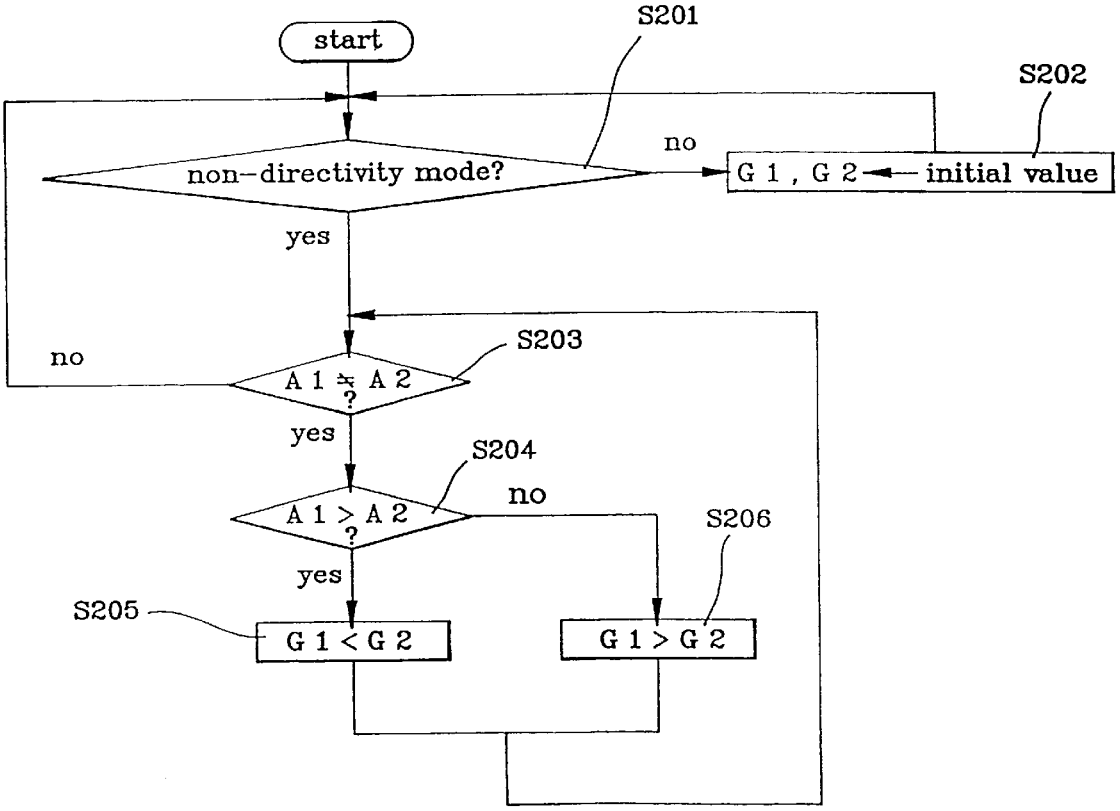
FIG. 11 is a flowchart for explaining the directivity controlling method of the microphone system according to the present invention.

FIG. 11 is a flowchart for explaining another embodiment of the directivity controlling method of the microphone system according to the present invention. This is for a case of inhibiting a plurality of audio inputs from involving directivity with a non-directional mode, which is applicable for all embodiments of the above-stated directivity controlling apparatuses of the microphone system.

First, in step S201, it is determined whether the microphone is in the non-directional mode or not in response to an external key input. If it is decided that the microphone is not in the non-directional mode, the program proceeds to step S202. Whereas, when the microphone is in the non-directional mode, it proceeds to step S203.

In step S202, amplification factors G1 and G2 are controlled to have previously-set initial values to return to step S201.

In case of the non-directional mode, it is determined whether two audio inputs A1 and A2 have the same level or not in step S203 to proceed to step S201 when they have the same level, thereby repeating the foregoing steps.

If two audio inputs A1 and A2 have the levels different from each other in step S204, it proceeds to step S204. Then, the magnitudes of two audio inputs A1 and A2 are compared with each other in step S204.

When it is decided that A1>A2, it proceeds to step S205. If not, the program proceeds to step S206.

In step S205, amplification factor G1 with respect to first audio input A1 is controlled to be smaller than amplification factor G2 with respect to second audio input A2. In other words, amplification factors G1 and G2 are variably controlled to lead the amplified values of audio input A1 and A2 to be identical to each other (to have the non-directivity).

When audio inputs A1 and A2 present the relation that A2>A1, amplification factor G2 with respect to second audio input A2 is controlled to be smaller than amplification factor G1 with respect to first audio input A1 in step S206. In other words, amplification factors G1 and G2 are variably controlled to permit the amplified values of audio inputs A1 and A2 to be identical to each other (to have the non-directivity).

In terms of the directivity controlling apparatus and method of the microphone system according to the present invention, the directional microphones are automatically controlled in the manner to be converted to the supervisory mode to have the directional sensitivities selectively different from each other.

Here, the controlling of the directivity also has the meaning to provide the non-directivity.

As described above, since the amplification factors with respect to the audio signals of corresponding channels are variably controlled via the comparison of the magnitudes of the plurality of microphone inputs, it is possible to provide the directivity of diverse modes even within the single microphone system.

When applying the present invention to a surveillance camera system, the plurality of microphones are employed to be able to afford the selective microphone directivity toward the sides that make the sound while it is easy to be applicable for effecting the focus and zoom control of the camera.

While the present invention has been particularly shown and described with reference to particular embodiment thereof, it will be understood by those skilled in the art that various changes in form and details may be effected therein without departing from the spirit and scope of the invention as defined by the appended claims.

For example, one embodiment of the present invention provides a directivity controlling apparatus and method of a microphone system in a periphery directional microphone, stereo microphone and middle/side stereo microphone, wherein an automatic shift operation is performed in a manner such that a directional microphone is categorized into a directional mode and a supervisory mode, audio signal levels received via a plurality of partial microphones are compared to select a certain microphone in accordance with the result of the comparison in the supervisory mode to advance to the directional mode by varying weighted values to make the selected microphone to have a specific directivity and, then, the input level of the partial microphone which is to have the directivity is monitored to repeat the supervisory mode in accordance with the monitored input level.

That is, the present invention is directed to provide a microphone system for shifting the directional microphone into a supervisory mode to have selectively different directional sensitivities.

Another embodiment of the present invention provides a directivity controlling apparatus of a microphone system including a supervisory part for monitoring the presence or absence of audio signal inputs or magnitudes of input levels by using audio signals collected via at least two microphones as inputs. Also, a controlling part controls a plurality of microphones to have respectively different directional sensitivities in accordance with the presence or absence of audio inputs or magnitudes of the audio inputs by being correspondent to the result of the monitoring by the supervising part. A directional sensitivity varying parts varies directional sensitivities with respect to respective plurality of microphones under the control of the controlling part.

In another embodiment of the present invention, a directivity controlling apparatus of a microphone system is formed by at least two microphones, and amplifiers respectively amplifying audio signals collected via respective microphones, and respectively having variably-controlled amplification factors. A comparing part receives the audio signals collected via respective microphones to compare the magnitudes of the received audio signals, and a controlling part varies the amplification factors of the amplifiers for allowing a specific microphone among the plurality of microphones to selectively have the directional sensitivity in accordance with the result of the comparison of the comparing parts.

Preferably, the comparing part includes quantizers for quantizing respective audio signals collected via the plurality of microphones, an operator for operating the output values of the quantizers and supplying a reference value, and comparators for respectively comparing the output of the operator with the quantized audio signals of respective quantizers.

Furthermore, controlling part has a timer for using time information supplied from the timer to control whether the directivity is to be continued or not in accordance with the result of deciding the presence and absence of input audio signals.

Alternatively, a directivity controlling apparatus of the present invention includes at least two microphones, and amplifiers respectively amplifying audio signals collected via respective microphones, and respectively having variably-controlled amplification factors. Additionally, a comparing part receives the audio signals collected via respective microphones to compare the magnitudes of the received audio signals, and a controlling part varies the amplification factors of the amplifiers for allowing the plurality of microphones to have the same level in accordance with the result of the comparison of the comparing part.

In another embodiment of the present invention, a directivity controlling method of a microphone system is performed by a first step of comparing magnitudes of a plurality of audio inputs in a supervisory mode resulting from an automatic shift or external key instruction, and a second step of variably controlling respective plurality of audio input amplification factors in accordance with the result of the comparison of the first step. Thereafter, a third step of comparing the audio inputs amplified in the second step with a predetermined reference value, and a fourth step of maintaining the variable amplification or repeating the first step in accordance with the result of the comparison of the third step are carried out.

It is preferable that a step of checking the presence or absence of audio inputs by using predetermined time information after the fourth step, and a step of maintaining the current variable amplification or repeating the first step in accordance with the presence or absence of the audio inputs resulting from the checking step are further executed.

In another embodiment, a directivity controlling method of a microphone system is performed by a first step of comparing magnitudes of plurality of audio inputs in a supervisory mode resulting from an automatic shift or external key instruction, and a second step of variably controlling amplification factors to allow the plurality of audio inputs to be identical with each other in accordance with the result of the comparison of the first step. Then, a third step is executed by maintaining or shifting the variable amplification after the second step by repeating from the first step.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A directivity controlling apparatus of a microphone system comprising:

a first microphone for providing a first audio signal;

a second microphone for providing a second audio signal;

a first amplifier for amplifying said first audio signal by a first amplification factor;

a second amplifier for amplifying said second audio signal by a second amplification factor;

a comparator for comparing magnitudes of said first and second audio signals, wherein said comparator includes:

a first quantizer for quantizing said first audio signal to generate a first magnitude;

a second quantizer for quantizing said second audio signal to generate a second magnitude;

an operator for operating said first and second magnitudes to provide an average value;

a first magnitude comparator for comparing said first magnitude with said average value; and a second magnitude comparator for comparing said second magnitude with said average value; and a controller for controlling said first and second amplification factors based on a result of the comparison of said comparator.

2. A directivity controlling apparatus of a microphone system as claimed in claim 1, wherein said controller includes circuitry for selecting one of said first and second microphones to have a certain directional sensitivity.

3. A directivity controlling apparatus of a microphone system as claimed in claim 1, wherein said controller includes a timer providing a predetermined time period and wherein said controller determines whether to maintain said first and second amplification factors in response to whether said first or second audio signal is present or absent during said predetermined time period.

4. A directivity controlling method of a microphone system, comprising:

generating a reference value by taking an average of a quantization value of a first audio signal and a quantization value of a second audio signal;

comparing said reference value with magnitudes of a first audio signal and a second audio signal, respectively; and variably controlling a first amplification factor and a second amplification factor in accordance with a result of said comparing so as to variably amplify said first and second audio signals to produce respectively a first amplified signal and a second amplified signal.

* * * * *

UNITED STATES PATENT AND TRADEMARK OFFICE

CERTIFICATE OF CORRECTION

PATENT NO. : 5,978,490
DATED : November 2, 1999
INVENTOR(S) : Hyun-Woo CHOI et al.

It is certified that error appears in the above-identified patent and that said Letters Patent is hereby corrected as shown below:

Title Page, Item [54], in the Title, after "APPARATUS", insert --OF A MICROPHONE SYSTEM AND A METHOD THEREOF--.

Signed and Sealed this

Tenth Day of April, 2001

*Attest:*

Nicholas P. Godici

NICHOLAS P. GODICI

*Attesting Officer*

*Acting Director of the United States Patent and Trademark Office*